US007199707B2

(12) United States Patent
Chu

(10) Patent No.: US 7,199,707 B2
(45) Date of Patent: Apr. 3, 2007

(54) MULTI-CHANNEL WIRELESS REMOTE CONTROL SYSTEM

(75) Inventor: Wen-Ching Chu, Hsinchu (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 190 days.

(21) Appl. No.: 11/128,346

(22) Filed: May 13, 2005

(65) Prior Publication Data

US 2006/0056438 A1 Mar. 16, 2006

(30) Foreign Application Priority Data

Aug. 31, 2004 (TW) ..... 93126178 A

(51) Int. Cl.
*G08B 1/08* (2006.01)

(52) U.S. Cl. ..... 340/539.1; 340/539.11; 340/286.02; 455/3.06; 455/3.05

(58) Field of Classification Search ..... 340/539.1, 340/539.11, 286.02; 455/3.06, 3.05, 66.1, 455/95

See application file for complete search history.

(56) References Cited

U.S. PATENT DOCUMENTS 4,488,153 A * 12/1984 Lange ..... 342/50
4,809,257 A * 2/1989 Gantenbein et al. ..... 398/128
5,019,814 A * 5/1991 Biggs et al. ..... 340/870.29
5,231,646 A * 7/1993 Heath et al. ..... 375/130
5,276,680 A * 1/1994 Messenger ..... 370/311
5,282,028 A * 1/1994 Johnson et al. ..... 725/139
5,337,314 A * 8/1994 Hoff et al. ..... 370/314
5,378,874 A * 1/1995 Holling et al. ..... 219/506
5,701,276 A * 12/1997 Bellini ..... 367/133
6,191,743 B1 * 2/2001 Jones et al. ..... 343/702
6,671,520 B1 * 12/2003 Kim ..... 455/556.1
6,842,617 B2 * 1/2005 Williams et al. ..... 455/444

* cited by examiner

*Primary Examiner*—Daryl C Pope
(74) *Attorney, Agent, or Firm*—Bacon & Thomas, PLLC

(57) ABSTRACT

A multi-channel wireless remote control system, which has N (an integer greater than one) wireless receiving devices and N (an integer greater than one) wireless transmitting devices. The N wireless transmitting devices corresponds to the N wireless receiving devices. The N wireless transmitting devices transmit frames to the respective N wireless receiving devices by a wireless carrier. Each frame contains a start bit, a device identification field to assign a receiving device, and a data field. Accordingly, i-th (i=1 to N) wireless transmitting device uses the device identification field to assign one of the receiving devices for receiving and sends data signal to the receiving device once every $Td_i$ time.

12 Claims, 5 Drawing Sheets

MULTI-CHANNEL WIRELESS REMOTE CONTROL SYSTEM

BACKGROUND OF THE INVENTION

1. Field of the Invention

The invention relates to a multi-channel wireless remote control system and, more particularly, to a multi-channel wireless remote control system using a same carrier.

2. Description of Related Art

Current electronics have developed quickly such that a function of wireless remote control is equipped in a lot of electronics for use convenience, such as a remote racing bicycle. Upon cost consideration, conventional wireless receiving and transmitting devices use an infrared as a carrier to send associated control signal and data. However, due to use habits, multiple remote racing bicycles may be used in a same location, namely, multiple pairs of receiving and transmitting devices exist in the location and use a same carrier frequency to operate, which easily causes interference and thus cannot have an appropriate operation.

To overcome the aforementioned problem, typically frequency hopping spread spectrum (FHSS) technology is used but requires more hardware for communication protocol. Another solution is no improvement, but a user can re-press associated control button(s) on the wireless transmitting device for re-transmission when the interference occurs. This may not increase the cost but definitely wastes the time for reset and re-transmission, which further reduces the use convenience of such a product.

Therefore, it is desirable to provide an improved system to mitigate and/or obviate the aforementioned problems.

SUMMARY OF THE INVENTION

The object of the invention is to provide a multi-channel wireless remote control system, which can allow multiple wireless transmitting devices concurrently using a same carrier to send control signals and data in a same location.

In accordance with one aspect of the present invention, there is provided a multi-channel wireless remote control system. The system includes N (an integer greater than one) wireless receiving devices and N (an integer greater than one) wireless transmitting devices. The N wireless transmitting devices correspond to the N wireless receiving devices. The N wireless transmitting devices transmit frames to the respective N wireless receiving devices by a wireless carrier. Each frame contains a start bit, a device identification field to assign a receiving device, and a data field. Accordingly, i-th (i=1 to N) wireless transmitting device uses the device identification field to assign one of the receiving devices for receiving and sends data signal to the receiving device once every $Td_i$ (i=1 to N) time.

In accordance with another aspect of the present invention, there is provided a multi-channel wireless remote control system. The system includes N (an integer greater than one) wireless receiving devices and N (an integer greater than one) wireless transmitting devices. The wireless transmitting devices correspond to the N wireless receiving devices. The N wireless transmitting devices transmit frames to the N wireless receiving devices by a wireless carrier. Each frame contains a start bit, a device identification field to assign one of the receiving devices, and a data field. Accordingly, i-th (i=1 to N) wireless transmitting device uses the device identification field to assign a respective receiving devices for receiving and sends data signal to the respective receiving device once every $Td_i$ (i=1 to N) time, where $Td_1, Td_2, \ldots, Td_N$ are mutually prime such that the wireless receiving devices accurately receive respective wireless data signals in an assigned time.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
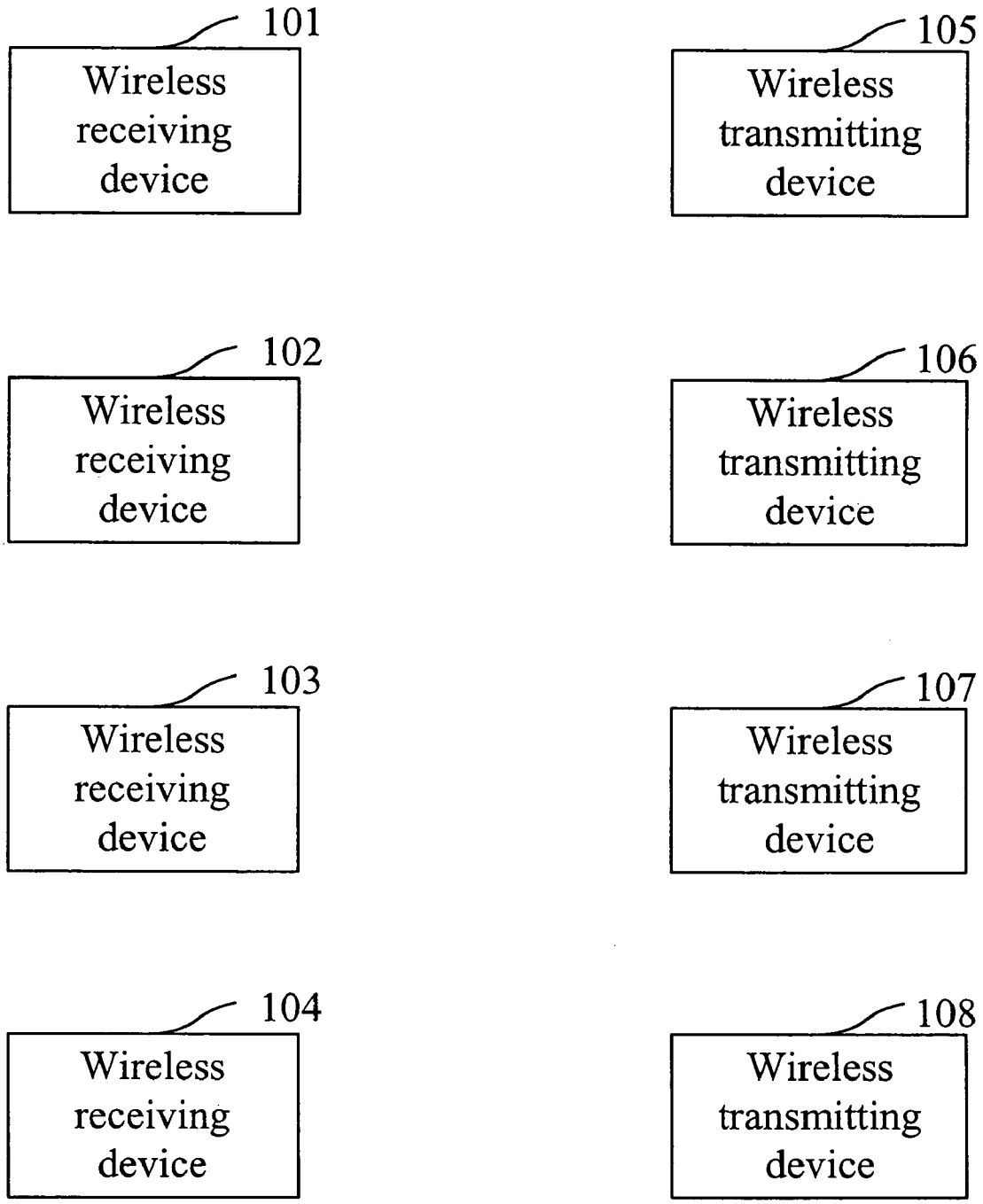
FIG. 1 is a schematic diagram of a multi-channel wireless remote control system in accordance with the invention.

FIG. 1 is a schematic diagram of a multi-channel wireless remote control system in accordance with the invention. As shown, the system includes four wireless receiving devices 101–104 and four wireless transmitting devices 105–108. The four wireless receiving devices 101–104 correspond to the four wireless transmitting devices 105–108. The four wireless transmitting devices 105–108 send wireless data signals with a same frequency wireless carrier to the four wireless receiving devices 101–104. The wireless carrier can be an infrared or radio frequency.

Figure 2:
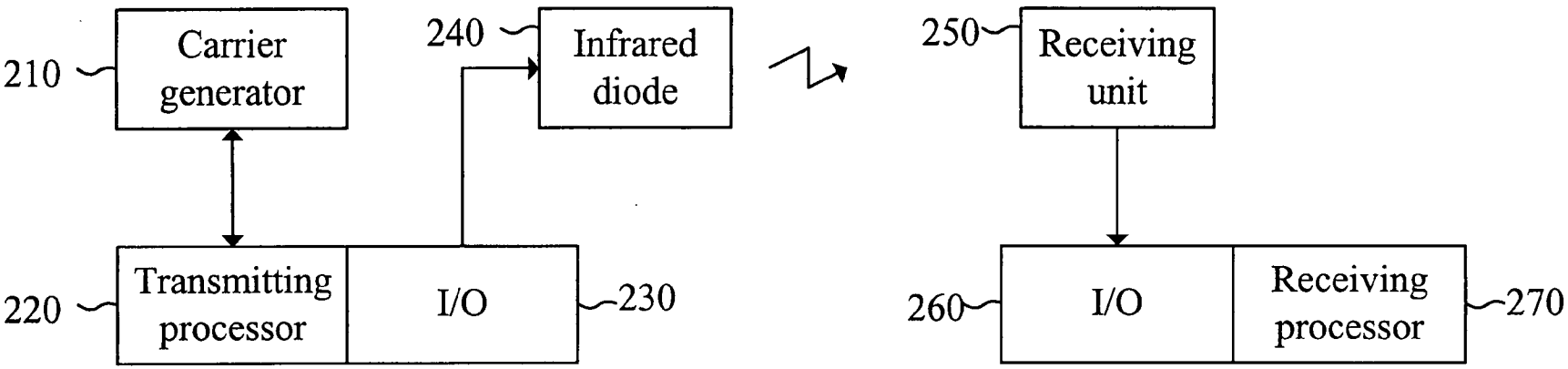
FIG. 2 is a block diagram of a wireless receiving and a wireless transmitting devices in accordance with the invention.

FIG. 2 is a block diagram of a wireless receiving 101, 102, 103, or 104 and a wireless transmitting devices 105, 106, 107 or 108 in accordance with the invention. As shown, the wireless transmitting device includes a carrier generator 210, a transmitting processor 220, an input/output (I/O) device 230 and an infrared diode 240. The carrier generator 210 generates a carrier for transmission. The transmitting processor 220 modulates digital data to be sent to the wireless receiving device and the carrier generated by the carrier generator 210, thereby obtaining a modulation signal. The modulation signal is sent to the infrared diode 240 through the I/O device 230 such that the infrared diode 240 transmits an infrared signal with the modulation signal. The wireless receiving device includes a receiving unit 250, an I/O device 260 and a receiving processor 270. The receiving unit 250 receives the infrared signal. The I/O device 260 sends the infrared signal to the receiving processor 270. The frequency of the carrier can be 36, 38 or 40 KHz. When a radio frequency is used, the infrared diode 240 can be replaced by a radio frequency (RF) transmitter, and the receiving unit 250 can be replaced by a RF receiver.

Figure 3:
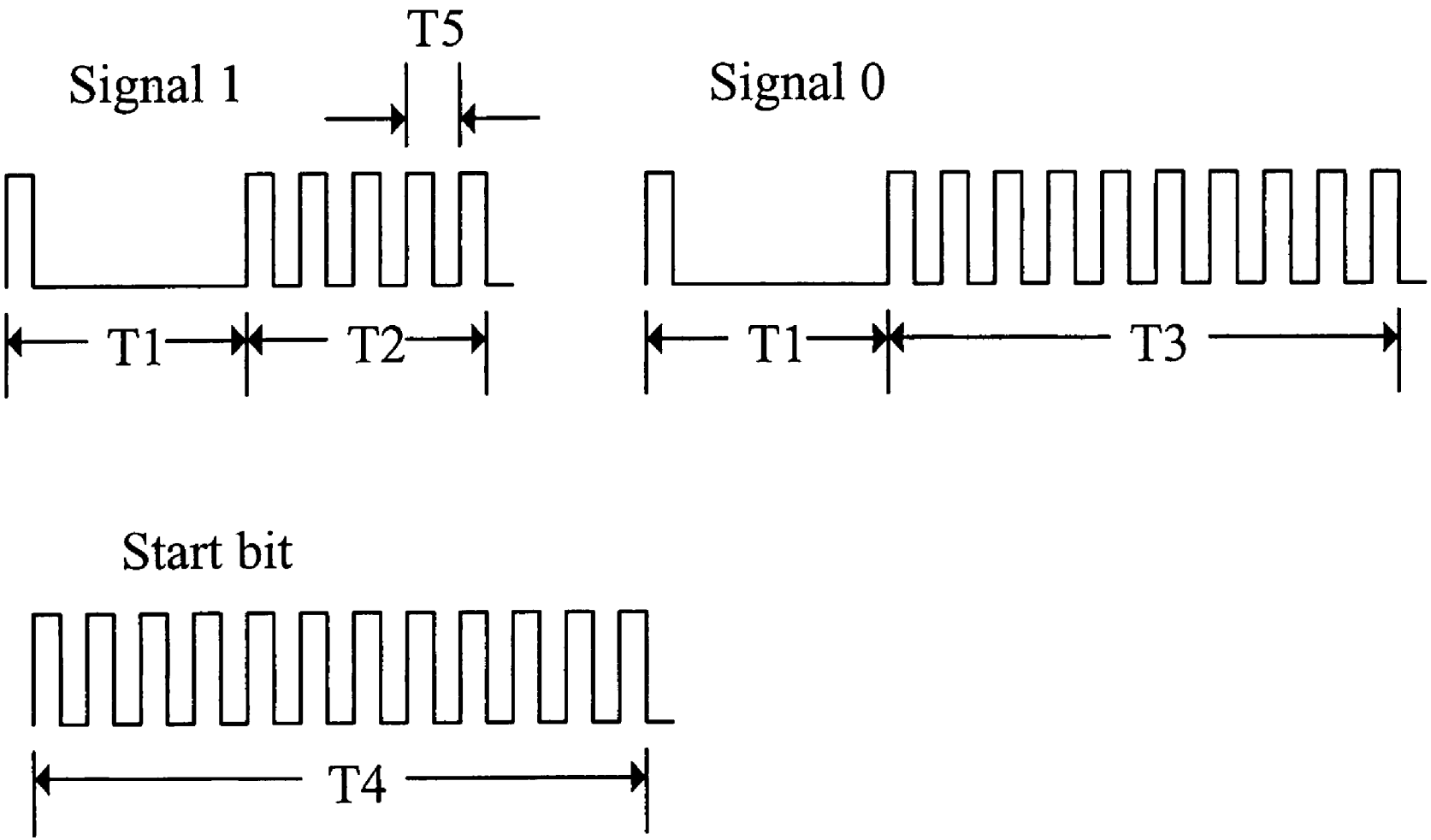
FIG. 3 is a graph of signals in accordance with the invention.

FIG. 3 is a graph of signals in accordance with the invention. As shown, signal 1 is a waveform of digital data 1 (digital high potential) after modulated by the transmitting processor 220, signal 0 is a waveform of digital data 0 (digital low potential) after modulated by the transmitting processor 220, and the start bit synchronizes wireless transmitting and receiving devices. Signals 0 and 1 are represented by different duration and transmitted after modulated by a carrier with a frequency such as 38 KHz, wherein T1 is a cutoff time that means no carrier transmission and T4 is a start bit duration. In this embodiment, T4>T3>T2, and T2~T4 are different such that the device 250 can determine a start bit, signal 1 or 0.

Figure 4:
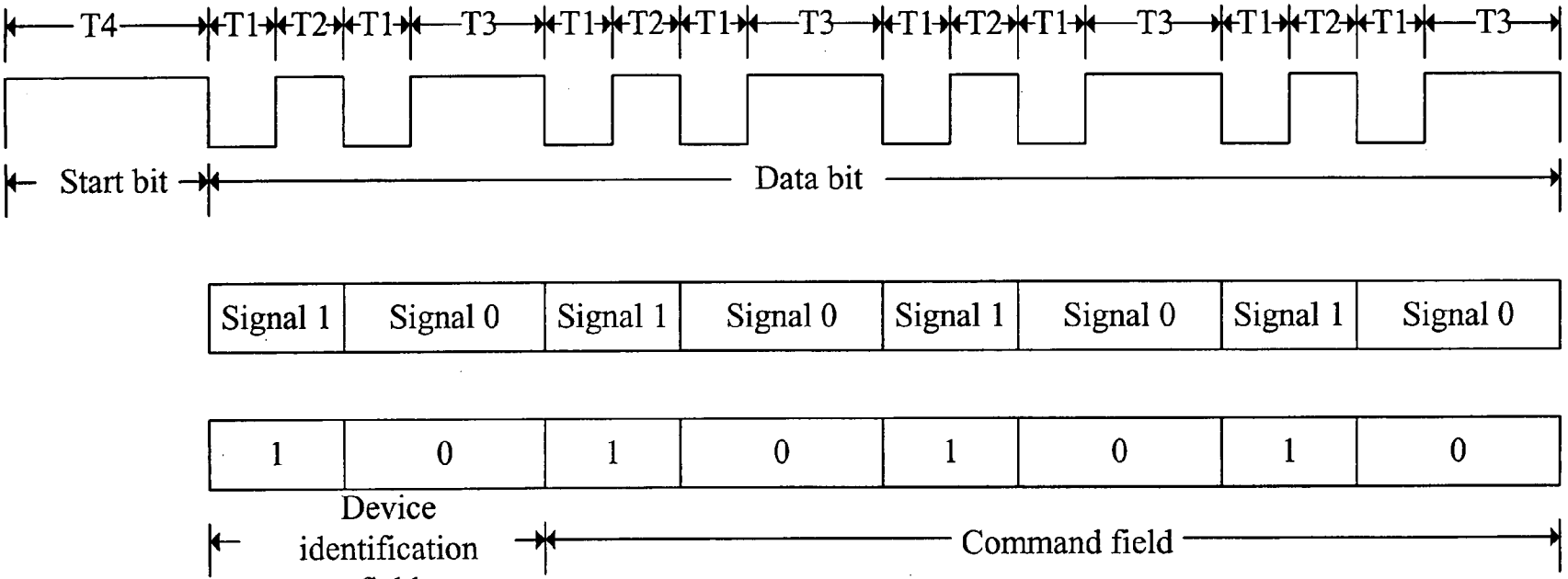
FIG. 4 is a schematic diagram of a transmitted frame in accordance with invention.

FIG. 4 is a transmitted frame in accordance with the invention. As shown, the transmitted frame contains a start bit and a 8-bit digital data having signals 1, 0, . . . , 1, 0 each data. In this case, the frame is a value of 0×AA, and the 8-bit digital data contains a device identification field and a command field. The device identification field locates at the first two bits to provide four devices for identification. Accordingly, when a wireless receiving device receives the digital data and compares it with its internal preset addresses, the receiving processor 270 executes a command of the command field if an internal preset address and a content of the device identification field are identical. On the contrary, the command is ignored. The command field locates at the last six bits to provide 64 commands.

Figure 5:
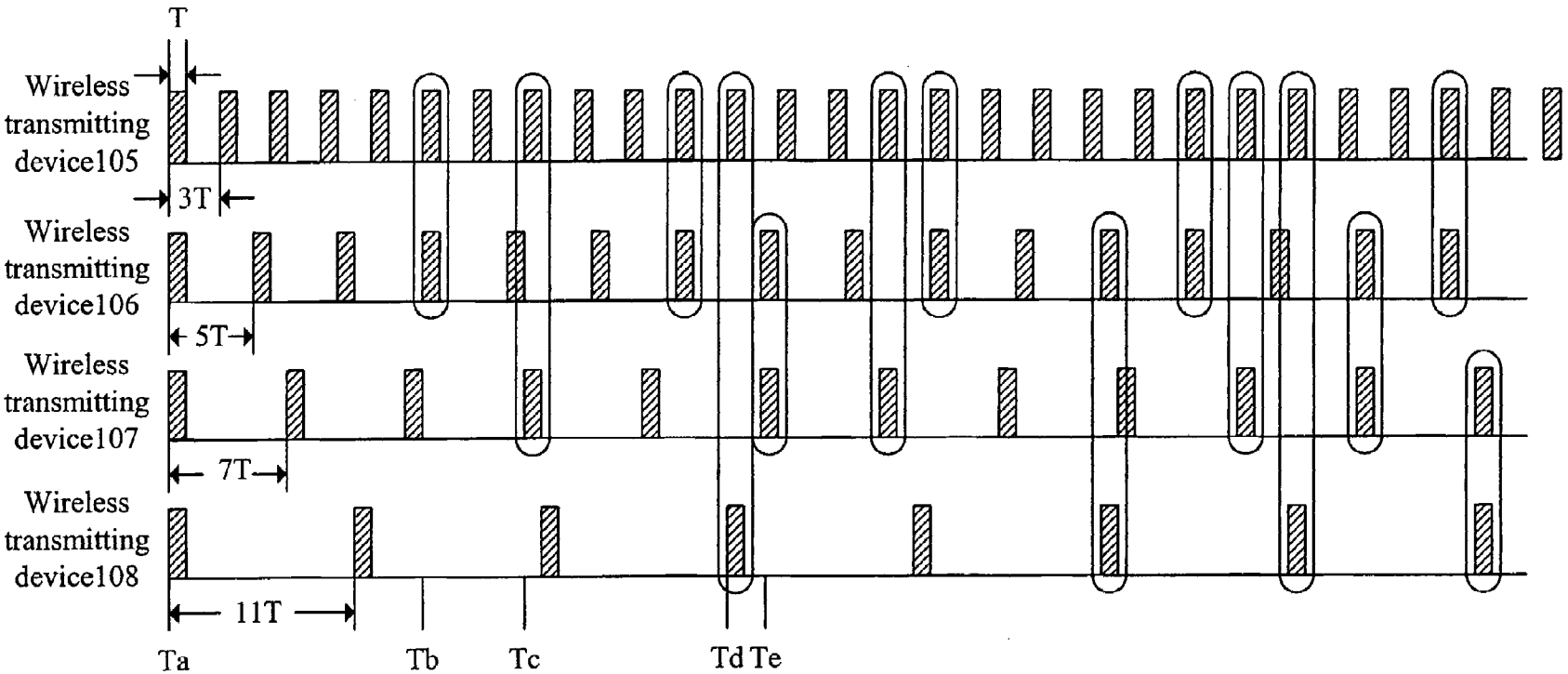
FIG. 5 is a timing diagram of transmitting data by wireless transmitting devices in accordance with the invention.

FIG. 5 is a timing diagram of transmitting data by wireless transmitting devices in accordance with the invention. The wireless transmitting devices 105–108 have the transmitting duration of $Td_1$, $Td_2$, $Td_3$ and $Td_4$ respectively. $Td_1$, $Td_2$, $Td_3$ and $Td_4$ are mutually prime such that the wireless receiving devices can accurately receive respective wireless data signals in a predetermined time. In this embodiment, $Td_1$, $Td_2$, $Td_3$ and $Td_4$ are 3T, 5T, 7T and 11T to allow the wireless transmitting devices 105, 106, 107 and 108 transmitting a frame once every 3T, 5T, 7T and 11T respectively. Accordingly, when the transmitted frames mutually interfere, the wireless transmitting device 105 has the highest priority to complete its frame transmission. As shown in FIG. 5, when frames sent by the wireless transmitting device 105 at Tb, Tc and Td have an interference with frames sent by the wireless transmitting devices 106–108 respectively, the device 105 successfully sends the frames at first. Similarly, the device 106 has a higher transmission priority than the device 107 and thus successfully sends its frame earlier than the device 107 after interference. Therefore, due to the different time set to frame transmission, the wireless transmitting devices have different priorities such that the wireless receiving devices can accurately receive respective wireless data signals in an assigned time.

In view of the foregoing, it is known that the invention gives the wireless transmitting devices different priorities by setting respective frame transmission time such that the wireless receiving devices can accurately receive respective wireless data signals in an assigned time, thereby overcoming the prior problems that multiple wireless transmitting devices cannot use a same carrier to transmit their data in a same location and the cost increases.

Although the present invention has been explained in relation to its preferred embodiment, it is to be understood that other possible modifications and variations can be made without departing from the spirit and scope of the invention as hereinafter claimed.

What is claimed is:

1. A multi-channel wireless remote control system, comprising:

N wireless receiving devices, for N greater than one; and

N wireless transmitting devices corresponding to the N wireless receiving devices, which transmit frames to the N wireless receiving devices by a wireless carrier, each frame containing a start bit, a data field and a device identification field to assign a receiving device;

wherein i-th (i=1 to N) wireless transmitting device uses the device identification field to assign a respective receiving devices for receiving and sends data signal to the respective receiving device once every $Td_i$ (i=1 to N) time.

2. The system as claimed in claim 1, wherein the wireless carrier has an infrared or radio frequency.

3. The system as claimed in claim 2, wherein the data signal has a start bit signal corresponding to the start bit of each frame, and signals 1 and 0 respectively corresponding to digital high and low potential such that the signals 1 and 0 form the device identification field and the data field.

4. The system as claimed in claim 3, wherein the frequency of the wireless carrier is 36, 38, or 40 KHz.

5. The system as claimed in claim 1, wherein each of the wireless transmitting device has a carrier generator, a transmitting processor, an input and output (I/O) device and an infrared diode.

6. The system as claimed in claim 1, wherein each of the wireless receiving devices has a receiving unit, an I/O device and a receiving processor.

7. A multi-channel wireless remote control system, comprising:

N wireless receiving devices, for N greater than one; and

N wireless transmitting devices corresponding to the N wireless receiving devices, which transmit frames to the N wireless receiving devices by a wireless carrier, each frame containing a start bit, a data field and a device identification field to assign a receiving device;

wherein i-th (i=1 to N) wireless transmitting device uses the device identification field to assign a respective receiving devices for receiving and sends data signal to the respective receiving device once every $Td_i$ (i=1 to N) time, where $Td_1$, $Td_2$, . . . , $Td_N$ are mutually prime such that the wireless receiving devices accurately receive respective wireless data signals in an assigned time.

8. The system as claimed in claim 7, wherein the wireless carrier has an infrared or radio frequency.

9. The system as claimed in claim 8, wherein each of the data signals has a start bit signal corresponding to the start bit of each frame, and signals 1 and 0 respectively corresponding to digital high and low potential such that the signals 1 and 0 form the device identification field and the data field.

10. The system as claimed in claim 9, wherein the frequency of the wireless carrier is 36, 38, or 40 KHz.

11. The system as claimed in claim 7, wherein each of the wireless transmitting devices has a carrier generator, a transmitting processor, an input and output (I/O) device and an infrared diode.

12. The system as claimed in claim 7, wherein each of the wireless receiving device has a receiving unit, an I/O device and a receiving processor.

* * * * *